United States Patent [19]

Weber

[11] Patent Number: 4,809,853

[45] Date of Patent: Mar. 7, 1989

[54] CARTON WITH IMPROVED CLOSURE MEANS

[75] Inventor: Frank J. Weber, St. Louis, Mo.

[73] Assignee: Ralston Purina Company, St. Louis, Mo.

[21] Appl. No.: 151,174

[22] Filed: Feb. 1, 1988

[51] Int. Cl.[4] ..... B65D 5/70

[52] U.S. Cl. ..... 206/621.4; 206/621.6; 206/626; 206/628; 206/631.2

[58] Field of Search ..... 229/125.42, 160.2; 206/621.3, 621.4, 621.6, 621.7, 631.2, 626, 628, 631.1

[56] References Cited

U.S. PATENT DOCUMENTS

| | | | |
|---|---|---|---|
| 1,842,237 | 1/1932 | Becker | 206/621.2 |
| 1,931,991 | 10/1933 | Mergentheim | 206/626 |
| 2,417,550 | 3/1947 | Guyer | 206/626 |
| 2,819,831 | 1/1958 | Polarek et al. | 206/626 |
| 3,097,785 | 7/1963 | Meyers | 206/626 |
| 3,226,003 | 12/1965 | Hickin | 206/631.1 |
| 3,270,941 | 9/1966 | Barnes | 206/626 |
| 3,301,391 | 1/1967 | Guyer | 206/626 |
| 4,194,677 | 3/1980 | Wysocki | 206/621.4 |
| 4,317,518 | 3/1982 | Mode | 206/621.4 |
| 4,569,443 | 2/1986 | Roccaforte | 206/626 |
| 4,650,078 | 3/1987 | Desmond et al. | 206/626 |
| 4,718,557 | 1/1988 | Friedman | 206/621.3 |
| 4,732,275 | 3/1988 | Hambleton et al. | 206/611 |

FOREIGN PATENT DOCUMENTS

| | | | |
|---|---|---|---|
| 606816 | 10/1960 | Canada | 206/621.3 |
| 98314 | 1/1984 | European Pat. Off. | 206/621.3 |
| 925975 | 5/1963 | United Kingdom | 206/621.3 |
| 2045723 | 11/1980 | United Kingdom | 206/621.3 |

*Primary Examiner*—Stephen Marcus
*Assistant Examiner*—Gary E. Elkins
*Attorney, Agent, or Firm*—Haverstock, Garrett and Roberts

[57] ABSTRACT

A carton for packaging a wide variety of dry frangible materials preferably formed from a unitary blank of foldable sheet material comprising respective pairs of opposed major and minor sidewall panels, a glue panel foldably joined to one of the major sidewall panels having a pouring opening formed therein, a plurality of closure flaps foldably joined to the upper and lower end portions of each of the respective sidewall panels, all of the respective panels and closure flaps being foldably joined to each other to form a carton assembly, a movable closure member attached to one of the minor sidewall panels adjacent the top end portion thereof and adaptable to overlap the pouring opening when the respective panels are foldably joined together, the closure member being initially secured to the glue panel adjacent the pouring member, a tab member mounted for rotational movement adjacent the lower end portion of the closure member, a plurality of partial die cuts associated with the rear surfaces of the closure member for initially separating the closure member from adjacent the pouring opening when a pulling force is exerted on the tab member, the closure member being thereafter movable between a closed position covering the pouring opening and an open position angularly related thereto allowing access to such opening for product removal, the tab member being frictionally engageable with the pouring opening when the closure member is reposition to its closed position.

5 Claims, 3 Drawing Sheets

CARTON WITH IMPROVED CLOSURE MEANS

The present invention relates generally to a carton for holding a wide variety of dry frangible products therewithin and, more particularly, to a folding carton construction having improved closure means associated therewith for reclosing a pouring opening formed in one of the sidewalls thereof, the closure means being engageable with the pouring opening to provide a positive seal therewith.

BACKGROUND OF THE INVENTION

Many different types of cartons for packaging dry frangible materials have been designed and manufactured for use in a multitude of applications and many such constructions are in commercial use. Such known assemblies teach a wide variety of constructions for removing contents from a carton in incremental amounts and thereafter reclosing the carton, including constructions which permit the opening of the top flaps associated with such cartons as well as constructions which utilize various types of pouring devices and means for opening and closing the same. The known prior art constructions for the most part are characterized by somewhat complicated and cumbersome mechanisms for opening and closing the same and many such constructions are expensive to manufacture and produce and many require additional parts over and above the original carton blank to complete the opening and closing mechanism. See, for example, the carton construction shown in U.S. Pat. No. 1,842,237. Other known constructions include a hinged pouring spout having a removable access tab located above and immediately adjacent thereto to prevent opening of the spout until the access tab is removed. See, for example, the carton construction shown in U.S. Pat. No. 4,569,443. Still other known cartons available and in commercial use include constructions which utilize an overlapping lid member built into the top of the carton, which lid member can the pulled up and folded back for access to and removal of the contents. The lid member can then be repositioned to again close the carton and prevent access to the contents stored therein. See, for example, the carton constructions disclosed in U.S. Pat. Nos. 2,417,550, 3,097,785 and 3,270,941. The construction of still another known carton assembly includes an opening in a minor sidewall having a hinged closure member attached thereto and a projection adapted to fit into such opening when the closure member is moved to its closed position. This construction has not been totally satisfactory since the closure member associated therewith tends to become loosened after repeated use thereby providing a relatively weak closure construction which does not adequately re-seal the carton after such extended use.

SUMMARY OF THE INVENTION

The present carton construction overcomes many of the disadvantages and shortcomings associated with the known constructions and teaches the construction and operation of a reclosable type carton having a pouring opening associated with one of the sidewalls thereof and a hinged closure member having a tab member located on the lower end portion thereof adapted to be inserted into means associated with the pouring opening to positively close and re-seal the opening as the contents of the carton are intermittently removed therefrom. The present carton includes a first major sidewall panel, a first minor sidewall panel, a second major sidewall panel, a second minor sidewall panel, and a glue panel having a pouring opening associated therewith, all of such panels being folded and joined to each other along fold lines to form a structure having a substantially rectangular cross-section and being open at both ends. The top and bottom ends of the present carton are sealed by conventional upper and lower closure flaps which are likewise foldably joined to their respective sidewall panels and spot glued in a conventional manner. The pouring opening associated with the glue panel is located adjacent to, but spaced from, the top portion of the carton when in its assembled condition.

One of the minor sidewall panels includes a hinged closure member which is positioned and dimensioned so as to overlap the pouring opening formed in the glue panel. The closure member or cover flap includes a tab member which is hingedly connected to the lower end portion thereof so that it can be pivotally folded and inserted into the pouring opening to close and re-seal the carton after a desired amount of contents has been removed therefrom. A pair of opposed slots are preferably located adjacent the lower edge portion of the pouring opening, the slots being dimensioned so as to frictionally receive the respective side edge portions of the tab member to further hold and secure the tab member in a closed and sealed condition within the pouring opening. The opposed slots act as a locking mechanism and help to ensure and prevent inadvertent opening of the closure member.

The present carton is made from a unitary blank of foldable sheet material having fold lines, die cuts, glue flaps and a pre-cut pouring opening incorporated therein, the carton blank being adapted to be shipped in a flat condition and quickly assembled for use in packaging a wide variety of dry frangible products. It is also recognized that the present carton blank can be shipped in a partially assembled condition leaving only the closing and sealing of the top and bottom closure flaps for final assembly. Various applications of the present carton include use in packaging dry foods for human and animal consumption, powdered detergent compositions, and any other dry frangible material. The present carton is preferably made from a paper board type material although other types of sheet material such as plastic impregnated fibrous sheet materials, starch impregnated plastic, and like materials may likewise be utilized in the practice of the present invention so long as such materials can be cut, scored and folded as will be hereinafter explained. It is anticipated that the present carton will generally be used without a separate lining member although, for certain uses, it may be desirable to use a conventional liner depending upon the type of product packaged therein.

It is therefore a principal object of the present invention to teach the construction and operation of an improved carton assembly having a reclosable pouring opening associated with one of the sidewalls thereof.

Another object is to provide a carton assembly having a pouring opening which may be repeatedly opened and closed by means of a hinged closure member having a hinged tab member associated therewith, the tab member being adapted for insertion into means located adjacent the lower edge portion of the pouring opening to provide a positive seal therewith and to tightly secure the carton in a closed condition to prevent unwanted spillage therefrom.

Another object is to provide a carton assembly having improved closure means associated therewith, such carton being formed from a unitary blank of sheet material having fold lines and die cut portions associated therewith adapted to be assembled into a carton in a conventional manner without the use of any additional elements of construction.

Another object is to teach the construction and operation of a carton assembly wherein a plurality of partial die cuts are associated with the rear surface of the closure member to enable member to initially separate from a sidewall thereof adjacent the pouring opening to provide access to the pouring opening when a pulling force is exerted on the tab member.

Another object is to provide a carton construction having more durable closure means associated therewith.

Another object is to teach the construction and operation of a reclosable carton which may be shipped in either a flat condition or a partially assembled condition.

Another object is to provide a carton construction which can be easily and quickly assembled for use in packaging a wide variety of dry frangible products.

Another object is to teach the construction and operation of a carton assembly which reduces the cost of manufacturing and producing the same.

These and other objects and advantages of the present invention will become apparent to those skilled in the art after considering the following detailed specification of the present carton assembly in conjunction with the accompaning drawings.

DETAILED DESCRIPTION OF THE INVENTION

Figure 1:
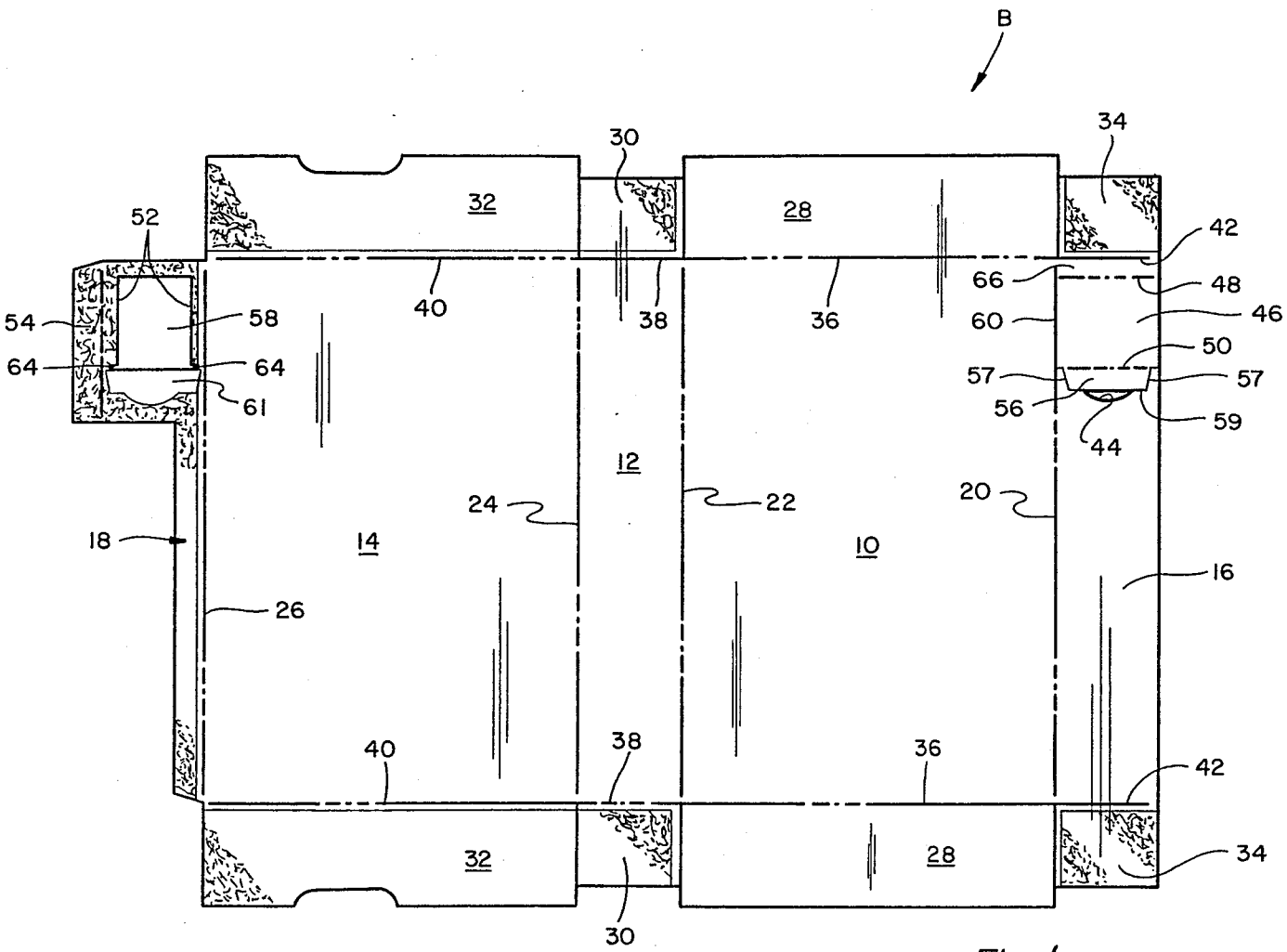
FIG. 1 is a plan view of the outside surface of a blank of foldable sheet material from which the carton of this invention may be formed.

Referring to the drawings more particularly by reference numbers and letters wherein like numerals and like letters refer to like parts, the letter B in FIG. 1 identifies a unitary blank of foldable sheet material from which the carton of this invention may be formed and assembled. The letter C in FIGS. 4–7 identifies a portion of the present carton showing the present closure means constructed according to the teachings of the present invention. Blank B includes a first major wall panel 10, a first minor wall panel 12, a second major wall panel 14, a second minor wall panel 16, and a glue panel 18, all of which panels are foldably joined to each other along fold lines 20, 22, 24 and 26 respectively to form a carton structure open at both ends. Glue panel 18 includes an extension or cover panel 54 which has a pouring opening 58 formed therein as will be hereinafter further explained. Closure of the top and bottom end portions of the present carton is accomplished by joining conventional upper and lower closure flaps 28, 30, 32 and 34, which flaps are likewise foldable along fold lines 36, 38, 40, and 42 respectively.

Figure 3:
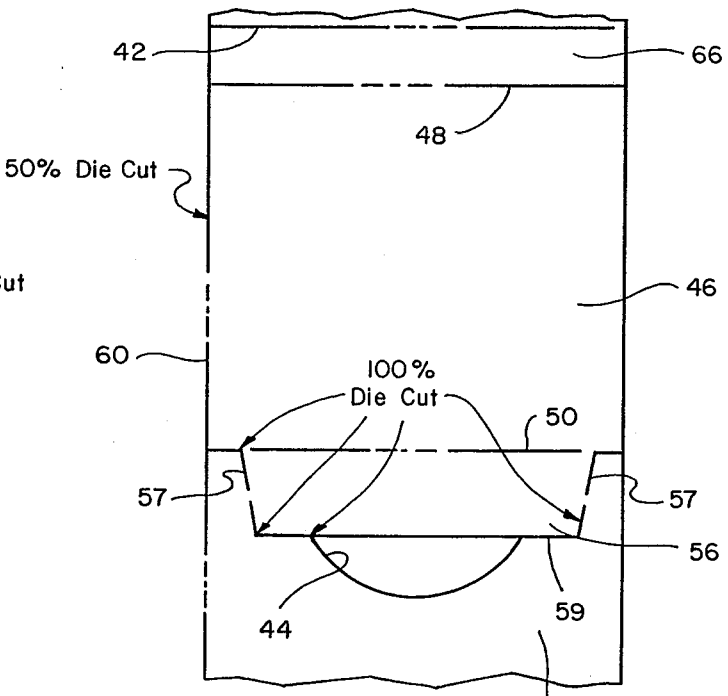
FIG. 3 is an enlarged front view of the hinged closure member shown in FIG. 1.

The wall panel 16 includes a closure member or cover flap 46 which is best shown in FIG. 3. The closure flap 46 is positioned adjacent to, but spaced from, the top edge 42 of panel 16 and is hingedly attached thereto by upper hinge means 48 as shown in FIGS. 1–7. The hinge means 48 enables the closure flap 46 to be moved from its closed position to its open position as will be hereinafter more fully explained and is preferably spaced from the top edge 42 of wall panel 16 in order to provide additional strength and stability to the structure when carton C is assembled. This positioning of the hinge means 48 avoids having the closure member 46 and the upper flap 34 hinged at the same location and this substantially prolongs the life of hinge means 48 since only one member, not two, pivotally rotates thereabout. Since the carton C is preferably made from a paper board type material, repeated movement of the closure flap 46 about hinge means 48 may eventually weaken such hinge and cause separation of the flap 46 from the panel 16 along such hinge. This deterioration and fatigue is even more likely to occur if both of the members 34 and 46 are hinged at the same location. The present positioning of hinge means 48 therefore not only increases the longevity of such hinge but it also makes the closure flap 46 more durable and better able to withstand normal wear and tear due to repeated use.

Figure 2:
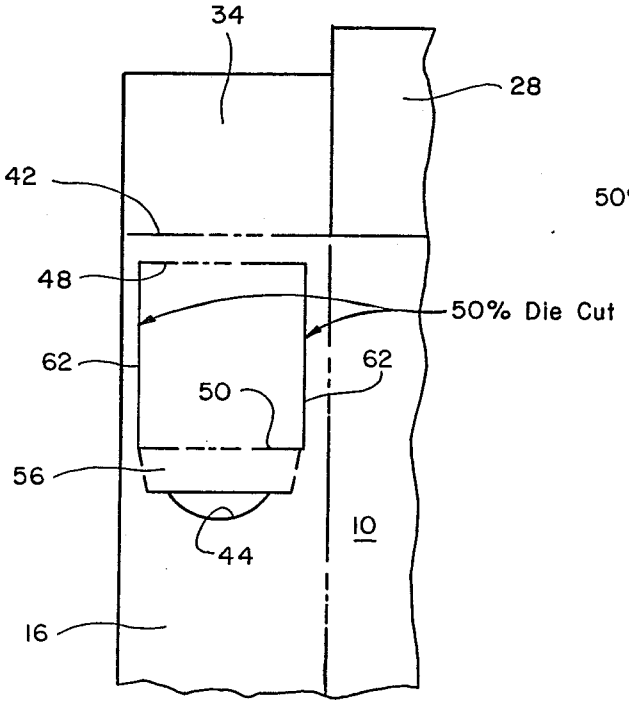
FIG. 2 is an enlarged partial view of the back side of the hinged closure member shown in FIG. 1.

The closure flap 46 also includes a tab member 56 (FIGS. 1–3) located at the lower portion thereof, the tab 56 being hingedly attached to the lower edge of flap 46 by means of the hinge 50. Both the hinge 48 and the hinge 50 are formed by creasing or scoring the sheet material of panel 16 at the proper locations during the manufacturing process. The tab 56 is provided for grasping by a user's hand to facilitate the initial opening of the carton C and is subsequently utilized for engaging the closure flap 46 with the pouring opening 58 to obtain a positive lock or seal therewith to re-seal the carton C after use. In this regard, the closure flap 46 is specifically designed to fold over, mate with and overlap the pouring opening 58 formed in the extension or cover panel 54 associated with the glue panel 18 as best shown in FIG. 1. Opening and closing of the closure flap 46 is achieved by die cutting the edge portion 60 of closure flap 46 from the back side thereof about 50% of the way through the foldable sheet material (FIG. 3). Also, the edge portions 62 associated with the back side of closure flap 46 as shown in FIG. 2 are likewise die cut from the back side thereof about 50% of the way through the foldable sheet material so that the closure flap 46 may be easily separated from the remainder of wall panel 16 and moved to its fully opened position to gain access to the pouring opening 58 as will be further explained. It is important to note that the edge portions 62 coincide with the opposed side edges 52 of the pouring opening 58 as shown in FIG. 1 and, when the wall panel 16 is positioned in overlapping relationship with the cover panel 54, the die cut edges 62 align and register with the side edges 52.

To facilitate the grasping of the tab member 56 after the carton C is initially sealed, the opposed side edges 57 as well as the lower edge 59 of the tab member 56 are die cut 100% all the way through the foldable sheet material (FIG. 3). This means that when the panel 16 is overlapped and mated with the panel 54, the tab 56 will remain unsealed and free to grab to initiate opening of the closure flap 46. To further facilitate such opening, a cut out portion or thumb opening 44 is provided in the wall panel 16 immediately below the lower edge 59 of the tab 56 as shown in FIGS. 1–3. When assembled, the opening 44 overlaps the area portion 61 (FIG. 1) associated with the cover panel 54 to form a recessed area 45 (FIGS. 4–7) so that a user may easily insert a thumb or finger therewithin for easy access to and grasping of the tab 56.

Figure 5:
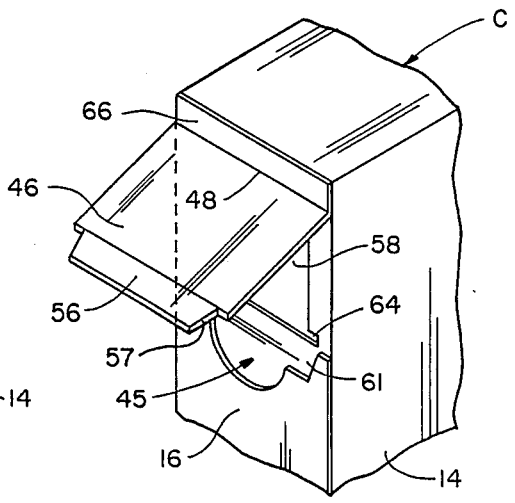
FIG. 5 is a perspective view of a portion of the present carton showing the hinged closure member in a partially open position.

Assembly of the blank B into the carton C is accomplished as follows. Glue panel 18 and its extension or cover panel 54 which completely surrounds pouring opening 58 on all four sides thereof will normally have adhesive on the entire surface thereof as well as on glue panel 18 and other flap surfaces as shown in FIG. 1 in order to securely fasten the various portions of blank B into a unitary carton and obtain maximum rigidity when the carton is so assembled. The area portion or pattern 61 which is a unitary part of cover panel 54 will not include any adhesive so that the tab 56 will remain free and may be easily accessed for opening the carton. Since the opening 58 is smaller than the closure flap 46, when the panels 16 and 54 are so joined, the closure flap 46 will be adhesively attached to the panel 54 adjacent all four sides of the pouring opening 58. Because the edge portions 60 and 62 of the closure flap 46 are partially die cut on the back surface thereof, when the closure flap 46 is initially moved upwardly by a pulling action on the tab 56, the member 46 will separate from the panel 54 along the die cut edges 60 and 62 to provide access to the opening 58 as shown in FIG. 5. More specifically, when the closure flap 46 is moved upwardly, that portion of member 46 immediately surrounding the pouring opening 58 adjacent the opposed sides thereof will break loose with a portion of the sheet stock remaining on each opposite side of the pouring opening 58 and a portion remaining on the respective sides of the closure flap 46. This is due to the location and positioning of the partial die cut edges 60 and 62. The die cut edges 62 also allow the closure flap 46 to tear evenly along the side edges 52 of the opening 58 thereby preventing an uneven or ragged separation from occurring. An uneven separation would leave stock material extending over into the opening 58 and partially obstructing the same, a feature which is not desirable. It is also recognized that, alternatively, for certain types of cartons and for certain designated applications and uses, it may be unnecessary to die cut the edges 62.

Figure 6:
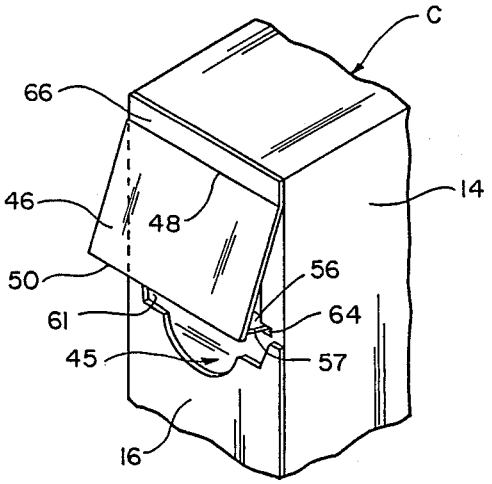
FIG. 6 is a perspective view of a portion of the present carton showing the hinged tab portion of the closure member partially inserted into the pouring opening.

Once the closure flap 46 is initially opened as previously described, it can be easily reinserted into the opening 58 by folding the tab 56 inwardly as shown in FIG. 6 and inserting the same into the opening 58. In this regard, the tab 56 is preferably constructed so as to be slightly wider than the opening 58 to ensure a tight snug fit between the side edges 52 of the opening 58 and the opposed tab edges 57 when inserted therewithin. Also, the tab edges 57 may be tapered slightly inwardly towards the lower edge 59 as shown in FIGS. 1–3 in order to facilitate insertion into the opening 58 so long as at least a portion of the respective tab edges 57 adjacent the hinge means 50 engage the opening side edges 52 to achieve a frictional fit therewith. This frictional fit serves to hold and lock the closure flap 46 in position over the opening 58 to prevent access thereto. Subseqent opening of the closure flap 46 is achieved by simply inserting one's finger within the recessed area 45 and grasping the lower edge of the closure member 46 along the hinge means 50 and pulling the same out and up to regain access to the opening 58.

The pouring opening 58 may preferably include a pair of opposed slots 64 positioned adjacent the lower end portion of each respective side edge 52 as shown in FIGS. 1 and 5, the slots 64 extending outwardly therefrom and being shaped and dimensioned so as to frictionally receive the opposed tab edge portions 7 when inserted therewithin. In this situation, tab 56 will again be slightly wider than the base of the pouring opening 58 so as to frictionally engage the slots 64. This provides a more positive means for holding the closure flap 46 in engagement with the opening 58 to seal the same. It is also recognized that use of the slots 64 may not be necessary in certain types of cartons adapted for particular uses. For example, heavy duty cartons and cartons made from reasonably rigid materials may not require use of such slots to satisfactorily re-seal the carton after use. In these situations, frictional engagement of the tab side edges 57 with the side edges 52 of the pouring opening 58 will provide an adequate seal and prevent the closure flap 46 from inadvertantly opening.

Figure 4:
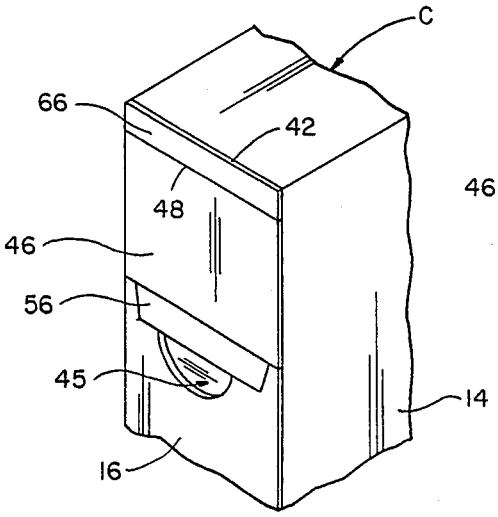
FIG. 4 is a perspective view of a portion of the present carton showing the hinged closure member in sealing relationship with the carton before the carton is opened.
Figure 7:
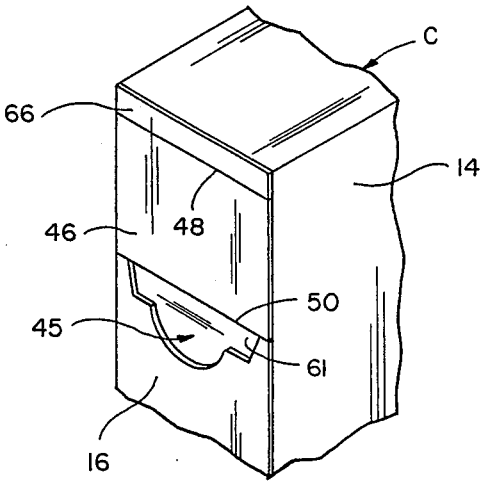
FIG. 7 is a perspective view of a portion of the present carton showing the hinged closure member in its reclosed position.

FIGS. 4–7 illustrate the various positions of the present closure member 46 relative to the pouring opening 58. For example, FIG. 4 represents the condition of the present carton C when it is initially assembled and sealed and shows the closure flap 46 in its initially closed and sealed condition over the pouring opening 58. FIG. 5 shows the closure flap 46 in a partially opened condition after the tab 56 has been pulled upwardly to open the pouring opening 58. The closure flap 46 is pivotally movable about hinge means 48 through approximately 180° of rotation between a fully closed position as shown in FIGS. 4 and 7 and a fully open position wherein the closure flap 46 abutts the upper portion 66 of side panel 16. This is important to the present invention because this means that the closure flap 46 can be positioned at any location between its fully opened and closed positions thereby enabling a user to control and meter the flow output of product from within the carton C.

FIG. 6 shows the closure flap 48 partially inserted within the opposed slots 64 and illustrates how the tab member 56 is pivotally rotted about hinge means 50 to a position which enables such tab to engage the slots 64. Once the tab side edges 57 engage the slots 64, the closure flap 46 can be easily and quickly positioned to its fully closed position as shown in FIG. 7 by merely pushing the flap 46 inwardly into engagement with the side panel 16. When moved to its fully closed position as shown in FIG. 7, the tab 56 is substantially perpendicular to the closure flap 46 and extends into the pouring opening 58 as best shown in FIG. 6. Although it is recognized that the closure flap 46 and the opening 58 may be located anywhere between the opposed end portions of the side panel 16, it is preferred that such members be located near the top portion of the carton as illustrated in FIGS. 4–7 for obvious reasons so that the packaged contents from a filled carton can be removed therefrom in incremental amounts without spillage.

Thus, when the present carton C is fully assembled and filled with contents and completely sealed, the closure flap 46 will remain an integral portion of the foldable sheet material and the tab member 56 will be unsealed so that a user may easily insert a thumb or finger into the recessed portion 45 and pull upwardly on the tab 56 thereby causing a separation of the sheet material associated with the flap 46 around the opening 58. The closure flap 46 may than be quickly and easily reclosed when the tab member 56 is reinserted into the pouring opening 58 as previously explained. In this manner, the blank sheet of material B can be die cut, creased and/or scored to provide a finished carton requiring no additional components and this can be easily accomplished with conventional equipment. The blank B can then be easily and quickly assembled in a conventional manner to provide an inexpensive carton which provides easy access to the product contained therewithin, provides for easy pouring of the contents from the pouring opening, and provides improved closure means which allows the pouring opening to be easily and quickly re-sealed in a tight condition when desired.

Thus, there has been shown and described a novel carton construction utilizing improved closure means, which carton fulfills all of the objects and advantages sought therefore. Many changes, modifications, variations, and other uses and applications of the present carton construction will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A carton adaptable for holding a substance therewithin comprising a pair of opposed first and second major sidewall panels having upper and lower closure flaps joined thereto, a pair of opposed first and second minor sidewall panels having upper and lower closure flaps joined thereto, a panel member foldably joined to one of said major sidewall panels, said closure flaps being secured in overlapping relationship to each other at each respective end of said carton to form a top and a bottom for said carton, said panel member and one of said minor sidewall panels having overlapping openings which form a pouring opening therein adapted for removal of the substance contained within said carton, a closure member pivotally mounted to one of said minor sidewall panels, said closure member being positioned and located to overlap said pouring opening and being rotatably movable between a closed position wherein said closure member restricts access to said pouring opening and an open position, a tab member pivotally mounted to said closure member to facilitate the opening thereof, said tab member being frictionally engageable with said pouring opening when said closure member is in its closed position, said pouring opening being located in said panel member and said minor sidewall panel adjacent to, but spaced from, said top of said carton, said closure member being pivotally mounted in overlapping relationship with said pouring opening to said minor sidewall panel adjacent to, but spaced from, said top of said carton, and said pouring opening having a pair of opposed slots located adjacent the bottom portion thereof, said slots being adapted to receive said tab member in frictional engagement when said closure member is in its closed position.

2. A unitary blank of foldable sheet material adaptable for assembly to form a carton comprising a pair of opposed major panels, a pair of opposed minor panels, and a glue panel, said major and minor panels and said glue panel being foldably joinable to each other to form an open ended carton, closure end flaps foldably attached to each opposite end of each of said major and minor panels, said closure end flaps being foldable and joinable to close the open ended portions of said carton, a pouring opening formed in said glue panel and a pouring opening formed in one of said minor panels, cut to overlap when said carton is assembled from said blank, said pouring opening including a pair of opposed edges, a closure member having front and rear surfaces attached to one of said minor panels, said closure member being adapted to overlap said pouring opening when said major and minor panels and said glue panel are foldably joined together, said closure member including a tab member mounted for rotational movement adjacent the lower end portion thereof, a plurality of partial die cuts associated with the rear surface of said closure member, at least some of said plurality of partial die cuts being positioned to register with the opposed edges of said pouring opening when said closure member is positioned in overlapping relationship therewith, said closure member being initially joined to said glue panel adjacent said opening when said carton is assembled, said plurality of die cuts enabling said closure member to initially separate from said glue panel along said die cuts to provide access to said pouring opening when a pulling force is exerted on said tab member, said closure member being thereafter movable between a closed position wherein said closure member restricts access to said pouring opening and an open position angularly related thereto, said tab member being engageable with said pouring opening when said closure member is subsequently repositioned to its closed position, said pouring opening being positioned in said glue panel and said minor panel adjacent to, but spaced from, the fold line between said minor panel and said attached closure flap to provide said pouring opening in said minor panel adjacent to but spaced from the end of said minor panel adapted to be the top of said carton when assembled, said pouring opening having a pair of opposed slots located adjacent the bottom portion thereof, said slots being adapted to receive said tab member in frictional engagement when said closure member is in its closed position when said carton is assembled.

3. The carton defined in claim 1 wherein said carton is formed from paper board.

4. The carton defined in claim 1 wherein said tab member is slightly greater in width than said pouring opening.

5. The carton defined in claim 1 wherein said tab member includes tapered side edge portions.

* * * * *